US006827464B2

(12) United States Patent
Koren et al.

(10) Patent No.: US 6,827,464 B2
(45) Date of Patent: Dec. 7, 2004

(54) POOL LIGHT CONTROLLER

(75) Inventors: Pinhas Paul Koren, Altamonte Springs, FL (US); Richard Heiner, Orlando, FL (US)

(73) Assignee: SuperVision International, Inc., Orlando, FL (US)

( * ) Notice: Subject to any disclaimer, the term of this patent is extended or adjusted under 35 U.S.C. 154(b) by 36 days.

(21) Appl. No.: 10/284,797

(22) Filed: Oct. 31, 2002

(65) Prior Publication Data

US 2004/0085754 A1 May 6, 2004

(51) Int. Cl.[7] ..... F21V 33/00

(52) U.S. Cl. ..... 362/96; 362/562; 362/101; 362/95; 362/85; 362/86; 362/154; 362/231; 362/800; 362/811; 362/806

(58) Field of Search ..... 362/96, 562, 101, 362/95, 85, 86, 154, 231, 259, 800, 811, 806; 40/106, 444, 716

(56) References Cited

U.S. PATENT DOCUMENTS 5,769,527 A * 6/1998 Taylor et al. ..... 362/85
6,030,108 A * 2/2000 Ishiharada et al. ..... 362/562

* cited by examiner

*Primary Examiner*—Stephen Husar
*Assistant Examiner*—Bertrand Zeade
(74) *Attorney, Agent, or Firm*—Terry M. Sanks, Esquire; Beusse Brownlee Wolter; Mora & Maire, P.A.

(57) ABSTRACT

A light controller device to control illumination characteristics of a light system, the device comprising a plurality of switches wherein each switch is operable to select at least one of a color of light and a pattern of light colors, a plurality of lights to illuminate at least one of a color of light and a pattern of light colors based on which switch of the plurality of switches is selected, a viewer window where the plurality of lights illuminates through the viewer window when the switch is selected, and a structure to hold the plurality of switches, plurality of lights, and viewer window.

27 Claims, 1 Drawing Sheet

POOL LIGHT CONTROLLER

BACKGROUND OF THE INVENTION

The present invention relates to a device to control illumination patterns emitted from a light source, and more particularly, to a controller device and a method wherein a user may visually see a light illumination pattern selected with the controller on the controller device.

Two lighting systems today that are capable of illuminating a plurality of colors or patterns of light colors are light emitting diode ("LED") light systems and fiber optic light systems. These light systems have been used for architectural lighting, such as interior and exterior lighting of residential homes, office complexes and/or other buildings, landscaping, such as illuminating sidewalks, pools of water, waterfalls, or any other area that needs to be illuminated, including underwater applications such as in swimming pools and spas. In each of these applications, some form of a controller device, or controller, is used to dictate whether the lights are on or off, as well as to select a color or pattern of colors. Typically, these controllers are placed at a location situated near the lights where a user is able to visually witness the choice of color(s) selected. For example, a pool light controller is typically placed near the pool so that the user can view the effect of the light color selected as the user activates the light choices with the controller. Additionally, the majority of controllers are pre-programmed wherein the user is only able to select certain patterns of colors to illuminate. Such controllers are usually located where the user can visually see the illuminated lights. Thus, locating the controller where the user cannot visually see the illuminated lights to determine if the color or pattern of colors selected is desirable is not currently a viable option when considering where to locate the controller.

BRIEF DESCRIPTION OF THE INVENTION

The present invention is directed to a controller device and a method that provides a visual indicator to a user wherein a user needs only to see the controller to determine a color or color pattern that has been selected. In one preferred embodiment a light controller device is provided that comprises a plurality of switches wherein each switch is operable to select a light color and/or a pattern of light colors. A plurality of lights to illuminate a light color and/or a pattern of light colors based on which switch is selected is also included. The invention also has a viewer window where a plurality of lights illuminates through the viewer window when the switch is selected. The device also has a structure to hold the plurality of switches, plurality of lights, and viewer window.

The present invention also discloses another preferred embodiment comprising a light operable to produce a plurality of single light colors and/or a pattern of light colors. A power source is connected to the light. A controller is connected to the light and is operable to control when the plurality of single light colors and/or the pattern of light colors are illuminated. The controller further comprises a second light source, selection buttons, and a viewer window wherein the second light source illuminates through the viewer window dependent on the plurality of single light colors and/or the pattern of light colors selected using the selection buttons.

In another preferred embodiment a method of allowing a user to view an illumination pattern of lights selected is provided. The method comprises providing a controller device comprising a view window to select a light illumination pattern, and providing a primary light system controlled by the controller. The light pattern is selected with a selection button on the controller. A light source operable to illuminate through the view, or viewer, window is also provided. The light pattern selected is viewed through the view window connected to the controller. After an acceptable light pattern is viewed, the primary light system is activated, or set to continue, to illuminate the light pattern based on the acceptable light pattern selected.

BRIEF DESCRIPTION OF THE DRAWINGS

The invention itself, both as to organization and method of operation, must be understood by reference to the following description in conjunction with the accompanying drawings, in which like numbers represent like parts throughout the drawings and in which.

DETAILED DESCRIPTION OF THE INVENTION

With reference to the figures, exemplary embodiments of the present invention will now be described. The scope of the invention disclosed is applicable to a plurality of uses. Thus, even though embodiments are described specific to lighting systems for swimming pools, the present invention is applicable to other uses or applications where lights and multicolored lights are used.

Figure 1:
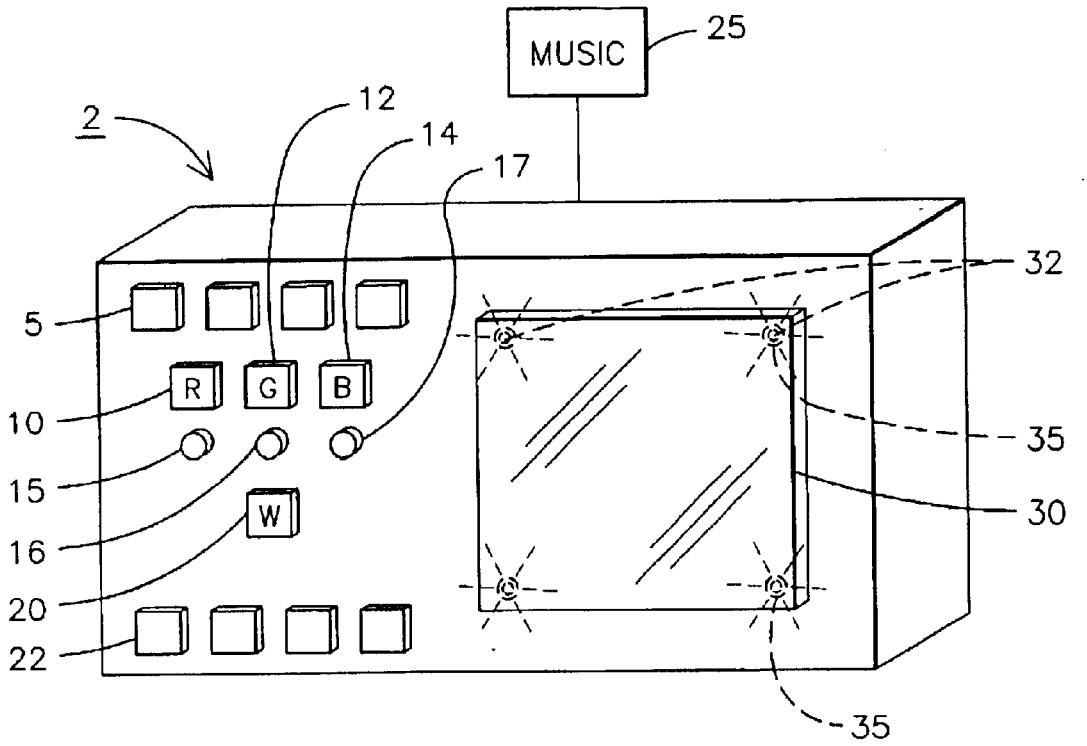
FIG. 1 illustrates a front view of an exemplary embodiment of the present invention.

FIG. 1 is an exemplary embodiment of the preferred invention. A controller is provided for selecting a color of light and/or a color pattern, or color of pattern of light colors. The controller is a processor for controlling the amount of current supplied to the LED system so that the amount of current supplied generates corresponding color within the color spectrum to produce illumination in any color in the spectrum. The processor is a programmable integrated circuit. A plurality of buttons 5 is disclosed on the controller 2, wherein each button represents a specific color and/or color pattern. In a preferred embodiment, the user may create his or her own light color pattern and then pre-program it into the controller 2 for later use.

Contained herein is an exemplary discussion of different patterns or how the different switches could possibly be laid out. As one skilled in the art will readily recognize, more than one approach may be used in establishing lighting combinations and patterns. Additionally more than one way of activating the lights is also available. Thus even though the term "switches" and "buttons" are used to describe activating the present invention, these terms are being used to describe a plurality of electrical and mechanical devices to carry out the functions disclosed. The intent here is to simply introduce various embodiments that may be included in the controller.

With respect to an LED light system, the primary three colors are red, green and blue. Thus, buttons 10, 12, 14 or switches are provided to illuminate red, green and blue. Each of these colors also has a second switch 15, 16, 17, or dimmer switch where a user can adjust the intensity of the color as well as select a combination of the colors and intensity to create a unique color, or to establish a color intensity for one of the primary colors. Once a new color is achieved, it can be programmed into the controller. In one embodiment, the highest intensity of the color is preset and the switch to change the intensity can only decrease the intensity, and is not capable of exceeding the highest intensity of that color.

As discussed, other switches are also provided, which may have preset colors, such as purple, orange, and yellow. A switch 20 specific for a white or clear light color is also provided. In another preferred embodiment, certain switches 22 may be pre-programmed with certain color patterns specific for certain ambience that a user may desire, such as a party mode, a romantic mode and/or a mode specific to a certain holiday. In another preferred embodiment, the controller 2 is connected to a music source 25, wherein a switch 5, 22 is provided to allow the lights to be controlled by the music. In other words, the lights will come on and off based on a pattern either preprogrammed or selected by the user, wherein the beat of the music dictates the lights' patterns.

As part of the controller 2, there is also a display window 30. Either at each corner of the display window or somewhere behind the display, view or viewer, window 30, a light emitter 32, such as LED bulbs, are placed so that when a color or pattern is selected, the color or pattern is illuminated through the display window 30.

Figure 2:
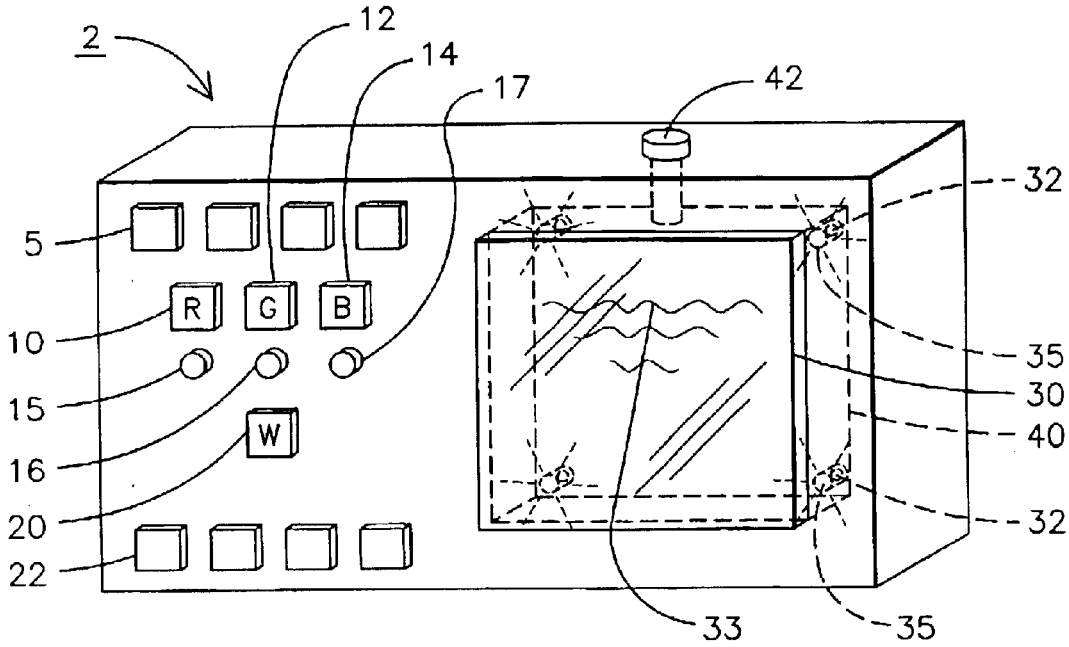
FIG. 2 represents another preferred embodiment of the present invention.

As illustrated in FIG. 2, in another preferred embodiment, when a controller 2 is used to illuminate water within a swimming pool or spa, in a preferred embodiment, a layer of water 33 is provided between the display window 30 and the LED 32 so that the user is provided a more realistic image of the lights selected, since lights illuminated under water do not necessarily illuminate the same as lights illuminated in air. The water 33 is maintained in a container 40 within the structure of the controller. Since, over time, water evaporates, the structure of the controller 2 has a closeable opening 42 where water 33 may be added and removed from the container 40.

Similarly, in another preferred embodiment, the lenses 35, or outer covering, of the LED bulbs 32 protrude into the container 40 containing the water 33 in the controller 5, thus providing a more authentic illuminated view of the light or pattern of lights selected. Thus, when permanently mounted, the user need not place the controller 2 at a location where the user is able to view the actual illumination of the body of water, such as the swimming pool, but instead, the controller 2 can be placed at a location more convenient to a user such as near the music source 25, where the user can use the display window 30 on the controller 2 to select the desired illumination color or pattern.

When selecting the illumination color or pattern, the system can be set to either only display the illumination color or pattern in the display window 30 first before activating the system to illuminate the pool, or the light system will illuminate the pool simultaneous with providing the illumination in the display window 30. In either embodiment, the user has the option to allow the pattern in the display window 30 to continue to be displayed after a selection is made.

While the invention has been described in what is presently considered to be a preferred embodiment, many variations and modifications will become apparent to those skilled in the art. Accordingly, it is intended that the invention not be limited to the specific illustrated embodiment, but be interpreted within the full spirit and scope of the appended claims.

We claim:

1. A light controller device to control illumination characteristics of a light system, said device comprising:

(a) a plurality of switches wherein each switch is operable to select at least one of a color of light and a pattern of light colors;

(b) a plurality of lights to illuminate at least one of a color of light and a pattern of light colors based on which switch of said plurality of switches is selected; and (c) a viewer window where said plurality of lights illuminates at least one of said color of light and said pattern of light colors through said viewer window when a respective switch of said plurality of switches is selected.

2. The device of claim 1 further comprising water placed behind said viewer window.

3. The device of claim 1 wherein said water resides in a container having an opening to at least one of add said water to said container and remove said water from said container.

4. The device of claim 2 wherein said plurality of lights is positioned behind said water and illuminates through said water.

5. The device of claim 2 wherein said plurality of lights are positioned wherein a lens of each said plurality of lights protrudes into inside of water and illuminates through said water.

6. The device of claim 3 wherein said plurality of lights are positioned wherein a lens of each said plurality of lights protrudes into said container holding said water and illuminates through said water.

7. The device of claim 1 further comprising a plurality of secondary switches where each individual secondary switch is associated with each individual plurality of switches to control an intensity of a LED light color.

8. The device of claim 1 further comprising a connector to a music source.

9. The device of claim 8 wherein a switch of said plurality of switches is programmable to allow at least one of a single light color and a pattern of light colors to flash in unison with music supplied by said music source.

10. The device of claim 1 further comprising a memory device to store at least one of an intensity of a light color and a pattern of light colors.

11. The device of claim 10 wherein at least said intensity of a light color and a pattern of light colors to be stored is selectable by a user.

12. The device of claim 1 wherein said lights are LED lights.

13. The device of claim 1 wherein said lights are fiber optic lights.

14. The device of claim 1 wherein said lights are high power laser lights.

15. An illumination system, wherein said illumination system comprises:

(a) a light operable to produce at least one of a plurality of single light colors and a pattern of light colors;

(b) a power source connected to said light;

(c) a controller connected to said light operable to control said light to produce at least one of a plurality of single light colors and a pattern of light colors are illuminated;

(d) said controller comprising a second light, a plurality of selection buttons, and a viewer window; and (e) wherein said second light illuminates through said viewer window dependent on at least one of a plurality of single light colors and a pattern of light colors selected using said selection buttons.

16. The system of claim 15 wherein said controller further comprising water placed behind said viewer window.

17. The system of claim 15 wherein said water resides in a container.

18. The system of claim 16 wherein said second light is positioned behind said water and illuminates through said water.

19. The system of claim 16 wherein said second light is positioned wherein a lens of said second light protrudes into inside of water and illuminates through said water.

20. The system of claim 15 further comprising a music source connected to said controller to control at least one of said plurality of single light colors and said pattern of light colors to illuminate in unison with music provided by said music source.

21. The system of claim 15 wherein said light and said second light are a plurality of LED lights.

22. The system of claim 15 wherein said light and said second light are fiber optic lights.

23. The system of claim 15 wherein said light and said second light are high power laser lights.

24. The system of claim 21 wherein a plurality of individual LED lights is placed at different locations behind said viewer window.

25. A method of allowing a user to view an illumination pattern of at least one of a light and a plurality of lights selected placed at a location remote from a controller, said method comprising:

(a) providing a controller device comprising a display window;

(b) providing a primary light system controlled by said controller to illuminate a light pattern;

(c) selecting said light pattern with a selection button on said controller;

(d) providing a light source within said controller which is operable to illuminate through said display window in unison with said light system and in sync with said light pattern;

(e) viewing said light pattern selected through said display window; and (f) after an acceptable light pattern is viewed, activating said primary light system to illuminate based on said light pattern selected.

26. The method of claim 25 wherein said step of viewing said light pattern selected further comprising illuminating said light pattern with said light system simultaneous with displaying said light pattern through said viewer window.

27. The method of claim 25 further comprising allowing a user to determine a specific illumination setting for said selection button.

* * * * *